US006264189B1

(12) United States Patent
Kawata

(10) Patent No.: US 6,264,189 B1
(45) Date of Patent: Jul. 24, 2001

(54) SHEET PROCESS APPARATUS

(75) Inventor: Wataru Kawata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/192,191

(22) Filed: Nov. 16, 1998

(30) Foreign Application Priority Data

Nov. 17, 1997 (JP) ..... 9-315527

(51) Int. Cl.[7] ..... B65H 43/00
(52) U.S. Cl. ..... 271/176; 414/789.9; 414/790.2
(58) Field of Search ..... 271/176; 414/789.9, 414/790.2; 270/58.04

(56) References Cited

U.S. PATENT DOCUMENTS 4,934,687 * 6/1990 Hayden et al. ..... 271/202
5,078,378 * 1/1992 Kapadia et al. ..... 271/301
5,181,705 * 1/1993 Ueda et al. ..... 271/176
5,462,265 * 10/1995 Mandel et al. ..... 270/58.09
5,621,501 4/1997 Matsuo et al. ..... 355/75
5,961,115 * 10/1999 Blanck et al. ..... 271/263
5,997,239 * 12/1999 Mimura et al. ..... 414/789.9
6,032,947 * 3/2000 Parker ..... 271/213

* cited by examiner

*Primary Examiner*—Donald P. Walsh
*Assistant Examiner*—David A Jones
(74) *Attorney, Agent, or Firm*—Fitzpatrick, Cella, Harper & Scinto

(57) ABSTRACT

The present invention provides a sheet process apparatus comprising a sheet discharge means for discharging a sheet, a first stacking means for stacking the sheet discharged by the sheet discharge means, a bundle discharge means for discharging a sheet bundle rested on the first stacking means, and a second sheet stacking means for stacking the sheet bundle discharged by the bundle discharge means. Wherein the number of sheets in the sheet bundle to be discharged onto the second stacking means is selected to become smaller, when a sheet size in a sheet conveying direction is great, than when a sheet size in the sheet conveying direction is small.

12 Claims, 17 Drawing Sheets

SHEET PROCESS APPARATUS

BACKGROUND OF THE INVENTION

1. Field of the Invention

The present invention relates to a sheet process apparatus, and more particularly, it relates to a sheet process apparatus in which, after imaged sheets discharged from an image forming apparatus such as a copying machine, a printer and the like are aligned or stapled, the sheets are stably discharged onto a stacking means.

2. Related Background Art

There has been proposed a sheet process apparatus in which, sheets discharged on a process tray (first stacking means) are aligned or stapled, the sheets are discharged onto a stack tray (second stacking means). In such a process apparatus, in case of a non-stapled sheet bundle in which a sheet bundle discharged on the stack tray is not stapled by a stapler, if the number of sheets in the sheet bundle is too great, upper several sheets in a sheet bundle already stacked on the stack tray may be disordered to worsen the stacking ability. Thus, to avoid this, in the past, the number of the sheets in the bundle has been selected to be relatively small.

However, in the conventional sheet process apparatus, the number of non-stapled sheets discharged from the process tray was the same or constant (for example, several sheets) regardless of the size of the sheet. Thus, when a length of the sheet in a sheet conveying direction is small, the sheets can stably be discharged onto the stacking means; however, when a length of the sheet in the sheet conveying direction is great, the weight of the sheet bundle may push out the sheet bundle already stacked on the stacking means to worsen the stacking ability.

SUMMARY OF THE INVENTION

An object of the present invention is to provide a sheet process means in which a sheet bundle including a large number of sheets can be discharged on a second stacking means without disordering already stacked sheets.

A sheet process apparatus according to the present invention comprises a sheet discharge means for discharging a sheet; a first stacking means for stacking the sheet discharged by the sheet discharge means; a bundle discharge means for discharging a sheet bundle rested on the first stacking means; and a second sheet stacking means for stacking the sheet bundle discharged by the bundle discharge means. And, wherein the number of sheets in the sheet bundle to be discharged onto the second stacking means is selected to become smaller, when a sheet size in a sheet conveying direction is great, than when a sheet size in the sheet conveying direction is small.

Concretely, the number of sheets in the sheet bundle discharged from the bundle discharge means is selected to a larger number as small size when the sheet size in the sheet conveying direction is smaller than 200 mm and 200 mm to 400 mm, and to a smaller number as large size when the sheet size in the sheet conveying direction is greater than 400 mm. Meanwhile, the number of sheets in the sheet bundle discharged from the bundle discharge means is selected to a larger number as small size when the sheet size in the sheet conveying direction is B5 size, A4 size and LTR size and R-type size such as B5R size, A4R size and LTRR size, and to a smaller number as large size when the sheet size in the sheet conveying direction is A3 size, B4 size and LEGL size.

An image forming apparatus according to the present invention comprises an image forming means; a sheet discharge means for discharging a sheet on which an image was formed, a first stacking means for stacking the sheet discharged by the sheet discharge means; a bundle discharge means for discharging a sheet bundle rested on the first stacking means; a second stacking means for stacking the sheet bundle discharged by the bundle discharge means; a sheet size detect means for detecting a size of the sheet; and a number counting means for counting the number of sheets discharged onto the first stacking means. And, wherein the number of sheets in the sheet bundle discharged from the first stacking means to the second stacking means is selected to become smaller, when a sheet size in a sheet conveying direction is great, than when a sheet size in the sheet conveying direction is small, on the basis of detection of the sheet size detect means and counting of the number counting means.

With the above-mentioned arrangement, the plurality of sheets are discharged onto the first stacking means by the sheet discharge means, and the sheet bundle on the first stacking means is discharged onto the second stacking means by the bundle discharge means. The number of the sheets in the sheet bundle to be discharged onto the second stacking means is determined in accordance with the length of the sheet in the sheet conveying direction (for example, about five when the length is small, and, about three when the length is great). In this way, the discharged sheet bundle is prevented from disordering the already stacked sheets by its own weight, thereby improving the sheet stacking ability for stacking the sheets onto the second stacking means.

Further, the number of the sheets in the sheet bundle may be determined in accordance with sheet groups (for example, small size group such as B5, A4 and LTR size, R-type size group such as LTRR, A4R and B5R size, and large size group such as B4, A3 and LEGL size).

According to the present invention, since the number of the sheets in the sheet bundle discharged from the first stacking means is determined on the basis of the length of the sheet in the sheet conveying direction and the determined sheets are discharged onto the second stacking means as the sheet bundle, the already stacked sheets on the second stacking means are not disordered, thereby stably discharging the sheet bundle onto the second stacking means.

DESCRIPTION OF THE PREFERRED EMBODIMENTS

Now, preferred embodiments of a sheet process apparatus according to the present invention and an image forming apparatus having such a sheet process apparatus will be fully explained with reference to the accompanying drawings.

First of all, an image forming apparatus according to the present invention (in this case, including a sheet process apparatus) will be described.

Figure 21:
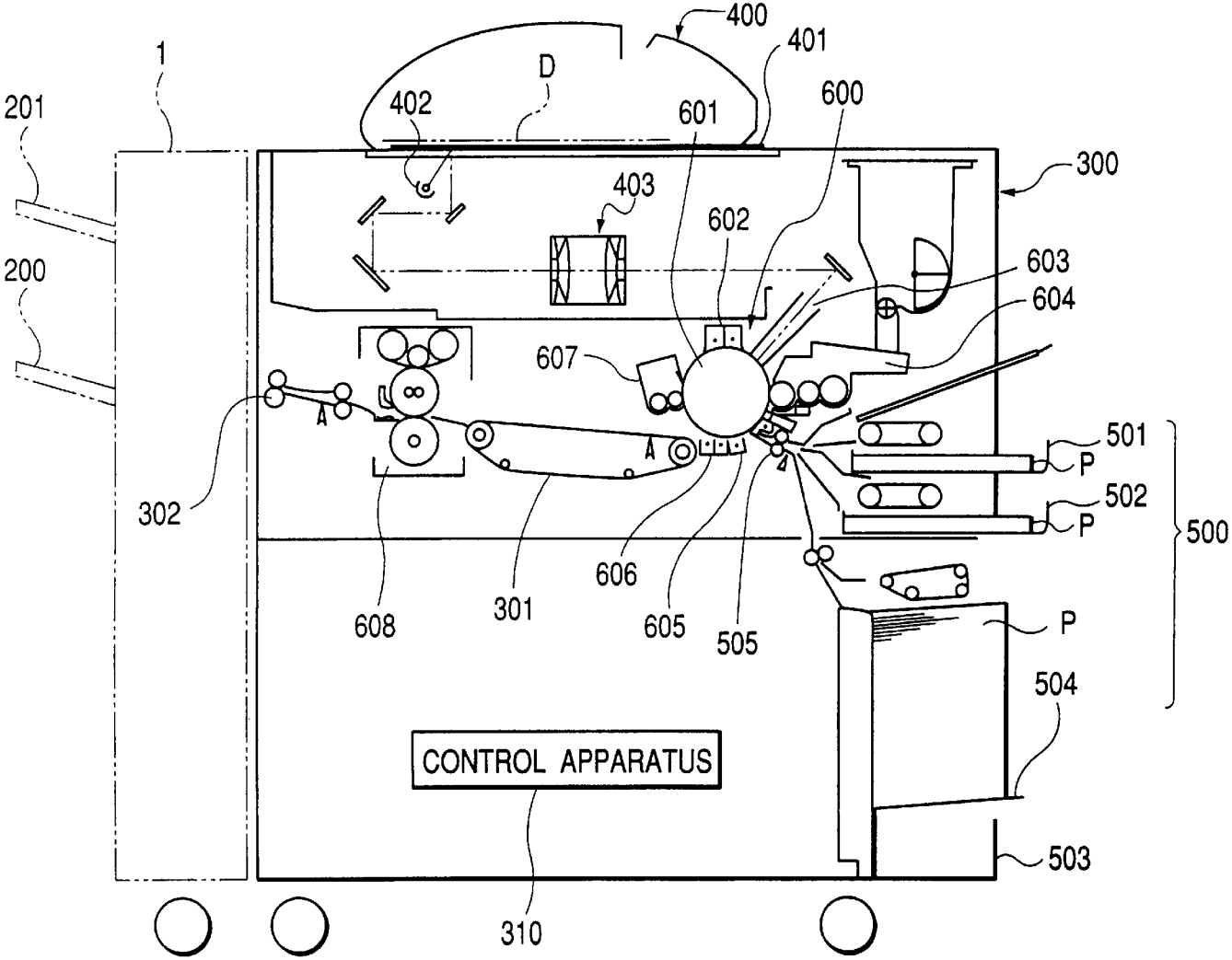
FIG. 21 is a front view of an image forming apparatus to which the sheet process apparatus according to the present invention can be applied.

FIG. 21 is a schematic sectional view showing an example of an image forming apparatus (copying apparatus) having a sheet process apparatus according to a preferred embodiment of the present invention.

In the apparatus, a main body 300 of the image forming apparatus (copying apparatus) is provided with an original reading portion (comprised of an original resting plate 401 such as a platen glass, a light source 42 and a lens system 403) for reading an original D automatically supplied by an automatic original supply device (RDF) 400, a sheet supply portion 500 for supplying a sheet P on which an image is to be formed, an image forming portion 600, and a sheet process apparatus 1 for processing and stacking the imaged sheets P discharged from a pair of discharge rollers (discharge means) 302.

The sheet supply portion 500 includes cassettes 501, 502 containing the sheets P and detachably mounted to the main body 300, and a deck 504 disposed on a pedestal 503. The image forming portion 600 includes a cylindrical photosensitive drum 601 around which a first charger 602, an exposure portion 603, a developing device 604, a transfer charger 605, a separation charger 606 and a cleaner 607 are disposed. A fixing device 608 is disposed at a downstream side of the image forming portion 600 with the interposition of a convey device 301 therebetween.

Next, an operation of the image forming apparatus 300 will be described.

When a sheet supply signal is outputted from a control device 310 of the image forming apparatus 300, the sheet P is supplied from the cassettes 501, 502 or the deck 504 of the sheet supply portion 500. On the other hand, an image of an original D rested on the original resting plate 401 is read by light from the light source 402, and light reflected from the original is illuminated onto the photosensitive drum 601 through the lens system 403. The photosensitive drum 601 was previously charged by the first charger 602. When the light is illuminated on the photosensitive drum, an electrostatic latent image is formed on the drum. The latent image is developed by toner from the developing device 604 to form a toner image.

Skew-feed of the sheet P supplied from the sheet supply portion 500 is corrected by a pair of regist rollers 505, and the sheet is supplied to the image forming portion 600 at a predetermined timing. Then, in the image forming portion 600, the toner image formed on the photosensitive drum 601 is transferred onto the sheet P by the transfer charger 605. Then, the sheet P to which the toner image was transferred is charged with opposite polarity by the separation charger 606 to be separated from the photosensitive drum 601.

Thereafter, the sheet P is sent, through the convey device 301, to the fixing device 608, where the transferred image is permanently fixed. The sheet on which the image was formed is discharged toward the sheet process apparatus 1 by the pair of discharge rollers 302.

Next, the sheet process apparatus according to the present invention will be explained.

<Brief Explanation of Sheet Process Apparatus>

Figure 1:
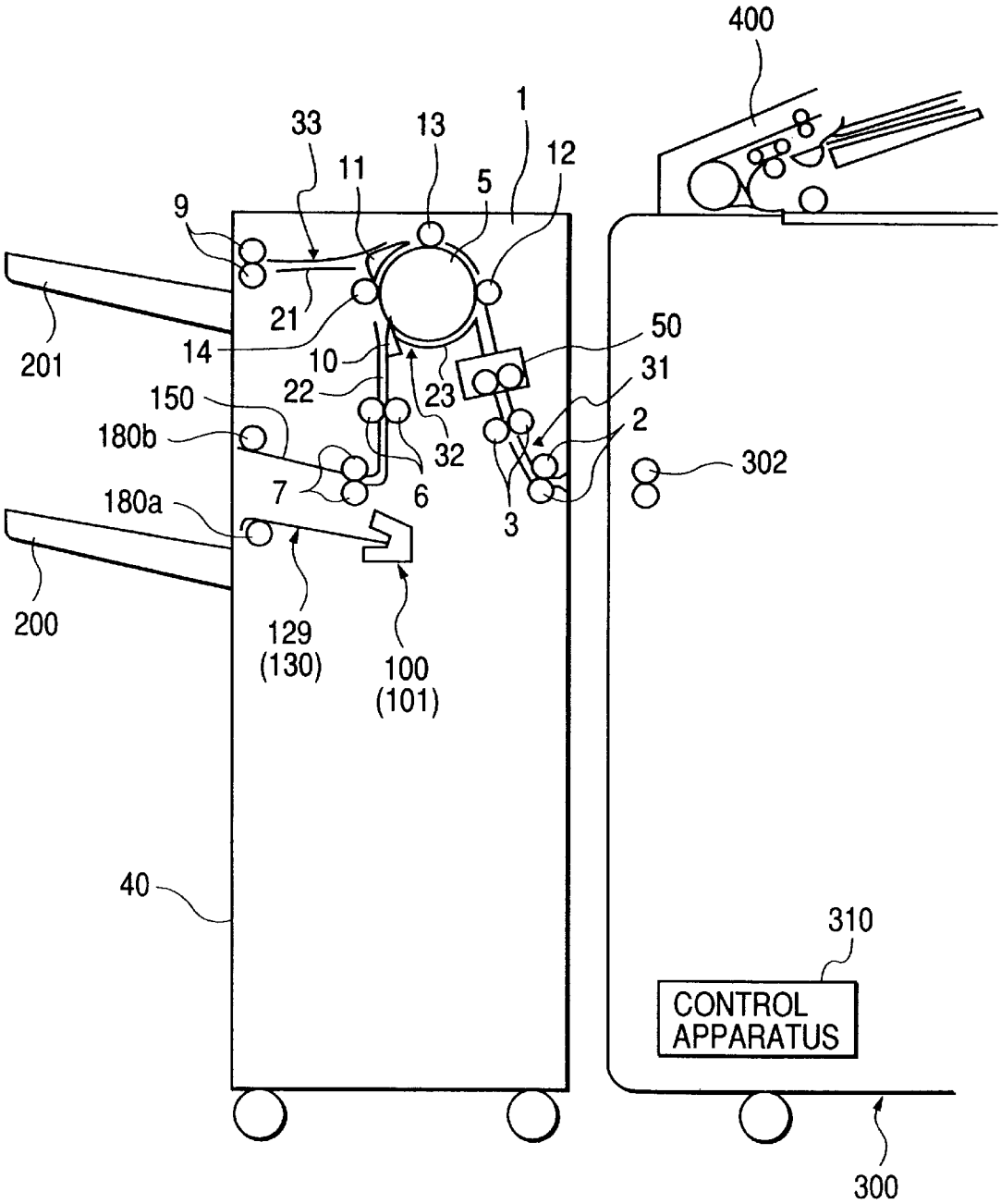
FIG. 1 is a front view of a sheet process apparatus according to the present invention.

First of all, main parts of the sheet process apparatus will be described with reference to FIG. 1 which is a schematic sectional view of the sheet process apparatus.

In the sheet process apparatus (referred to as "finisher" hereinafter) 1, a pair of inlet rollers 2 serve to receive the sheet discharged from the pair of discharge rollers 302 of the image forming apparatus 300. A pair of first convey rollers 3 serve to conveyed the received sheet P. An inlet sheet detect sensor 31 serves to detect the passage of the sheet. A punch unit 50 serves to form a hole in the sheet P in the vicinity of the trail end thereof. The sheet P is urged against a large convey roller (referred to as "buffer roller" hereinafter) 5 having a relatively large diameter by means of urging sub-rollers 12, 13, 14 disposed around the buffer roller.

A non-sort path 21 and a sort path 22 can be selected alternately by a first switch flapper 11. A second switch flapper 10 can alternately select the sort path 22 and a buffer path 23 for temporarily storing the sheet P. A sensor 33 serves to detect the sheet P in the non-sort path and a sensor 32 serves to detect the sheet P in the buffer path 23.

A pair of second convey rollers 6 are disposed in the sort path, and a process tray unit 129 includes an intermediate tray (referred to as "process tray" hereinafter) for collecting the sheets P temporarily and aligning the sheets and for permitting staple process of a stapler 101 of a staple unit 100. A roller (lower bundle discharge roller at a fixed side, in the illustrated embodiment) 180*a* which forms a part of a pair of bundle discharge rollers (transport means) is disposed at a discharge side of the process tray (first stacking tray) 130. A pair of first discharge rollers 7 for discharging the sheet P onto the process tray (first stacking tray) 130 are disposed in the sort path 22. A pair of second discharge rollers 9 for discharging the sheet P onto a sample tray 201 is disposed in the non-sort path 21.

An upper discharge roller 180*b* is supported by a rock guide 150 so that, when the rock guide 150 is brought to a closed position, the upper discharge roller is urged against the lower bundle discharge roller 180*a* to bundle-discharge the sheets stacked on the process tray 130 onto a stack tray (second stacking means) 200. A bundle stacking guide 40 serves to support a trail edge (in a bundle discharging direction) of the sheet bundle rested on the stack tray 200 and the sample tray 201 and also acts as an outer frame of the sheet process apparatus 1.

<Detailed Explanation of Staple Unit>

Figure 2:
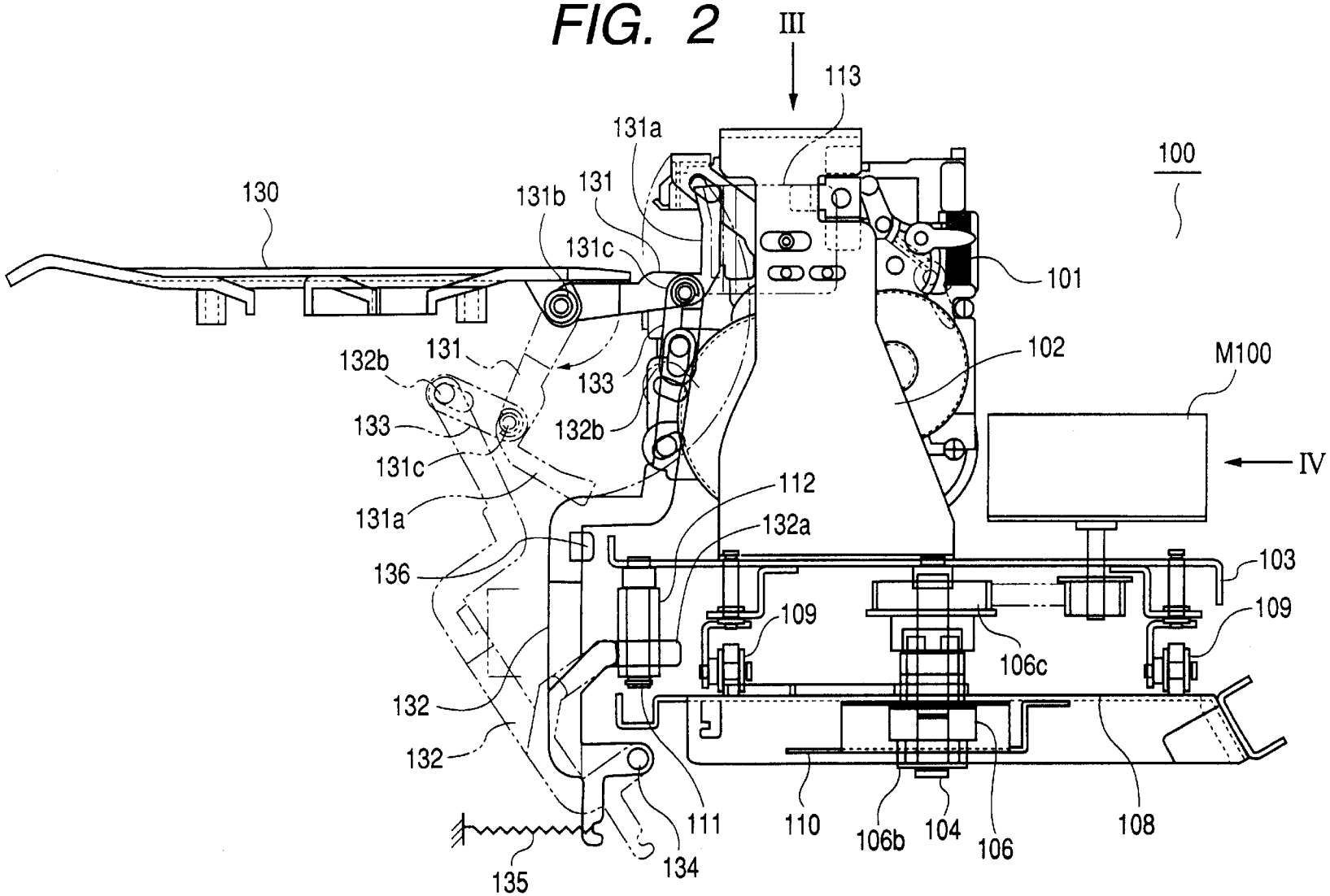
FIG. 2 is a side view showing a stapler and a process tray portion.
Figure 3:
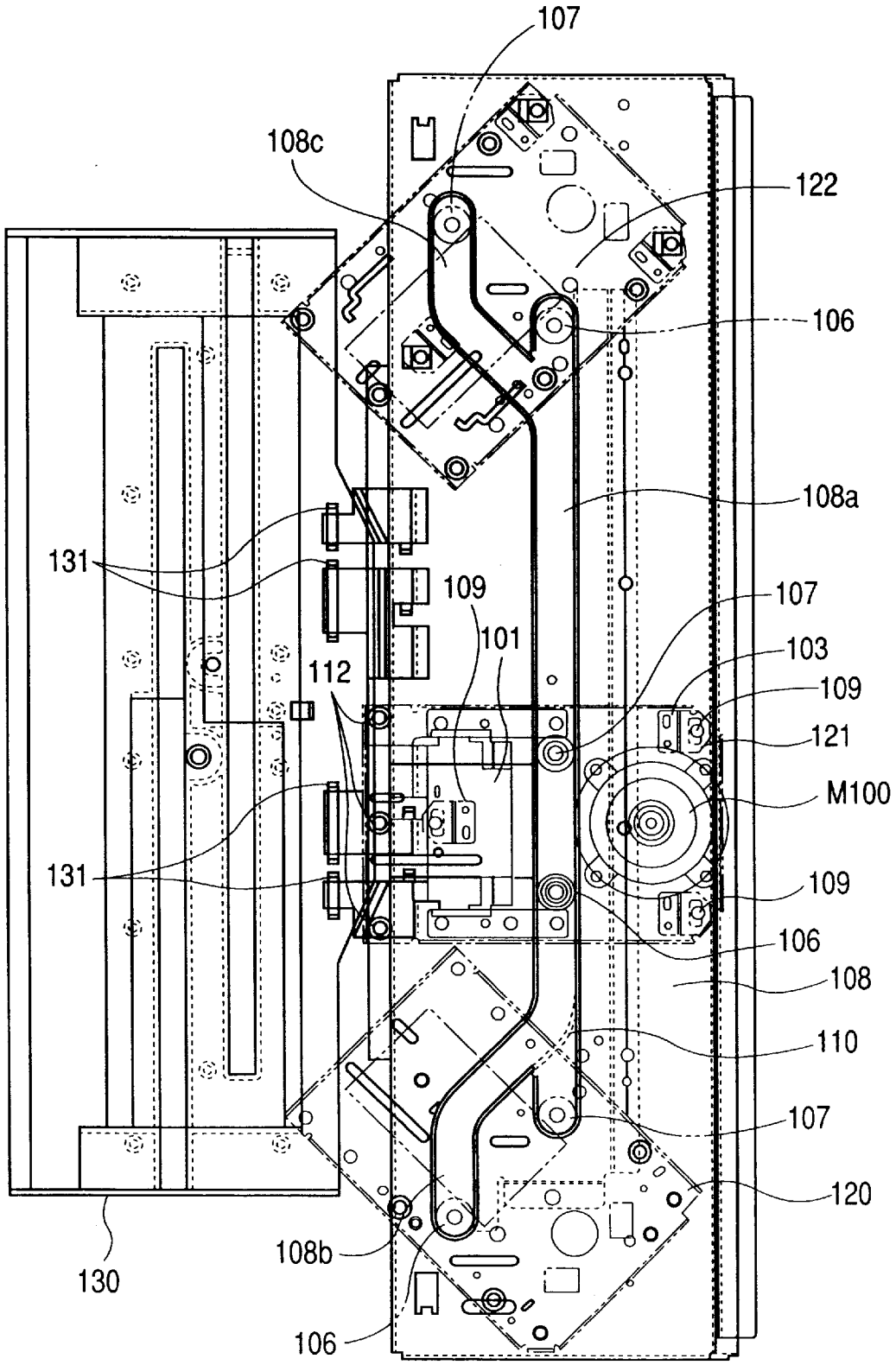
FIG. 3 is a plan view of a stapler shifting mechanism, looked at from a direction III in FIG. 2.
Figure 4:
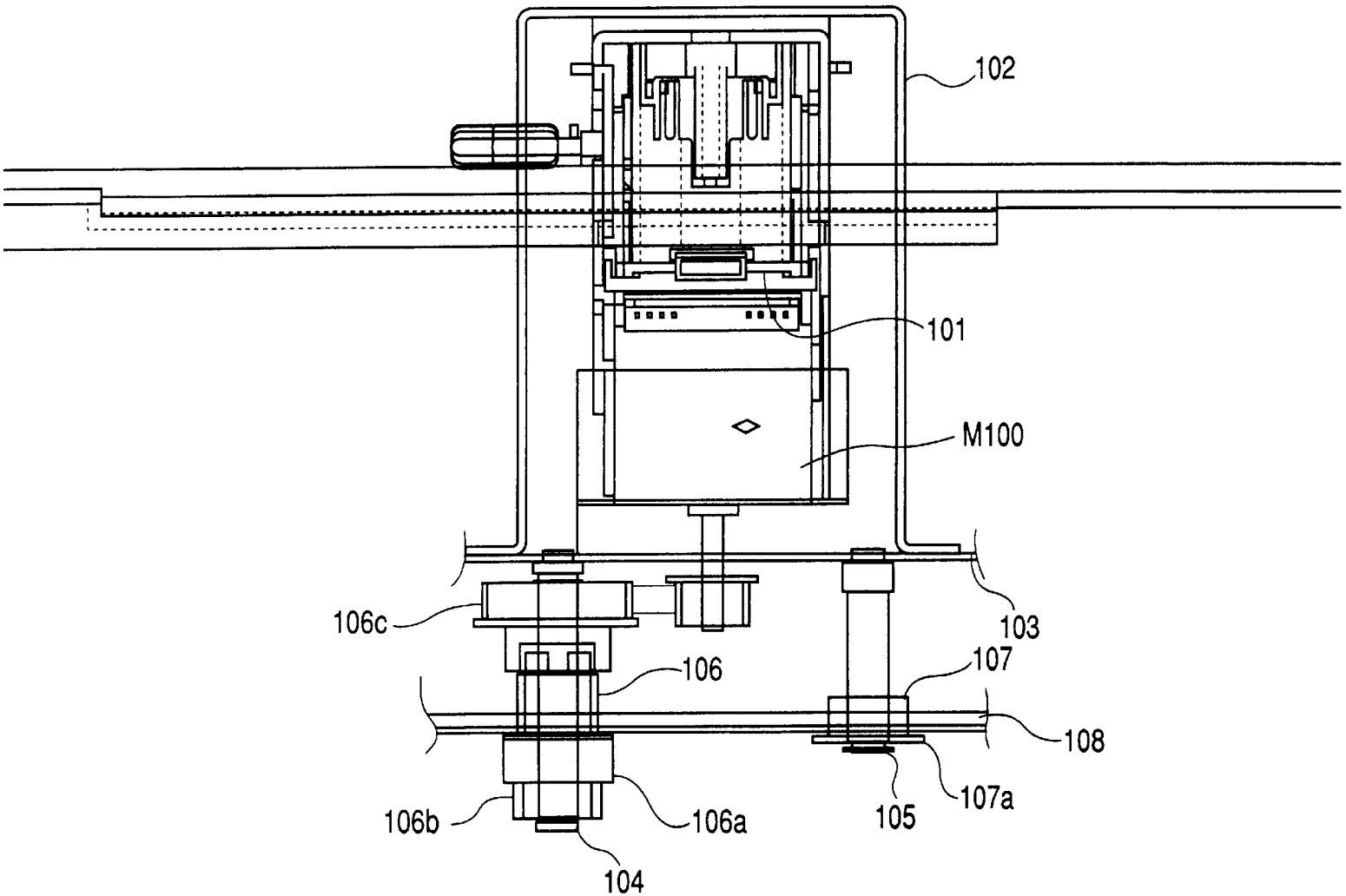
FIG. 4 is a back view of the stapler, looked at from a direction IV in FIG. 2.

Next, the staple unit 100 will be fully described particularly with reference to FIGS. 2, 3 and 4.

A stapler (staple means) 101 is secured to a shift plate 103 via a holder 102. The shift plate 103 has a set of stud shafts 104, 105 fixed in parallel with trail edges of the sheets stacked on the process tray 130. Rolling sub-rollers 106, 107 rotatably attached to the stud shafts 104, 105 are shiftably engaged by a series of hole-shaped parallel guide rails 108*a*, 108*b*, 108*c* formed in a fixed plate 108.

The rolling sub-rollers 106, 107 have flanges 106*a*, 107*a* having a diameter greater than widths of the series of hole-shaped guide rails 108*a*, 108*b*, 108*c*, and three support sub-rollers 109 are provided at a lower part of the shift plate 103 for holding the stapler 101 so that the shift plate 103 can be shifted on the fixed plate 108 along the series of hole-shaped guide rails 108*a*, 108*b* and 108*c*.

As apparent from FIG. 3, the series of hole-shaped guide rails 108*a*, 108*b* and 108*c* are designed to include a main guide rail hole portion (108*a*), a left end guide rail hole portion (108*b*) branched from the left end portion of the main portion and extending in parallel with the main portion, and a right end guide rail hole portion (108*c*) branched from the right end portion of the main portion and extending in parallel with the main portion. Accordingly, (i) when the stapler 101 is positioned at a left end side, the rolling sub-roller 106 is located at the left end of the rail hole portion 108*b* and the rolling sub-roller 107 is located at the left end of the rail hole portion 108*a* so that the stapler is maintained in a condition that the stapler is inclined rightwardly by a predetermined angle, and (ii) when the stapler is positioned at an intermediate position, the rolling sub-rollers 106, 107 are both located within the rail hole portion 108*a* to maintain the stapler in a non-inclined condition or parallel condition, and (iii) when the stapler 101 is positioned at a right end side, the rolling sub-roller 107 is located at the right end of the rail hole portion 108*c* and the rolling sub-roller 106 is located at the right end of the rail hole portion 108*a* so that the stapler is maintained in a condition that the stapler is inclined leftwardly by a predetermined angle. Changing of such postures of the stapler 101 is effected by an action cam (not shown).

The staple unit 100 is provided with a position sensor (not shown) for detecting home positions of the stapler 101. Normally, the stapler 101 is located at the left end home position (front side).

<Detailed Explanation of Stapler Shifting Mechanism>

Next, a mechanism for shifting the stapler 101 will be fully described.

The rolling sub-roller 106 of the shift plate 103 is provided with a pinion gear 106*b* integrally formed with the lower flange 106*a* and an upper belt pulley 106*c* integrally formed. The pinion gear 106*b* is connected to a drive motor M100 via a drive belt extending between an output pulley of the drive motor and the belt pulley 106*c* and is meshed with a rack gear 110 secured to the fixed plate 108 along the rail hole portion so that the shift plate 103 can be shifted together with the stapler 101 in a width-wise direction of the sheet in accordance with normal and reverse rotations of the drive motor M100.

Stopper laying sub-rollers 112 provided on stud shafts 111 extending downwardly from the lower surface of the shift plate 103 serve to rotate a trail end stopper 131 of the process tray 130 in order to prevent interference between the trail end stopper 131 and the stapler 101 (described later).

<Detailed Explanation of Trail End Stopper>

Next, the trail end stopper 131 for receiving and supporting the trail edges of the sheets P rested on the process tray 130 will be fully described.

The trail end stopper 131 is formed to protrude vertically from a stacking surface of the process tray 130 and has an abutment support surface 131*a* for receiving and supporting the trail end of the sheet P. The abutment support surface 131*a* can be rocked downwardly in a direction shown by the arrow around a pivot pin 131*b* provided on a lower surface of the process tray 130. A main link 132 has a cam surface 132*a* against which the stopper laying sub-roller 112 abuts to urge the cam surface and is positioned by abutting it against an abutment plate 136. Further, the main link can be rocked around a shaft 134 secured to a frame (not shown) in opposition to a tension spring 135. A pin 132*b* provided at an upper end of the main link is slidably received in an elongated hole formed in one end of a connection link 133 having the other end pivotally connected to the trail end stopper 131 via a pin 131*c*.

Accordingly, in this case, regarding the trail end stopper 131 shifted to a position where the stopper interferes with the stapler 101 as the shift plate 103 is shifted, when the cam surface 132*a* of the main link 132 is pushed by the stopper laying sub-rollers 112 of the shift plate 103, the trail end stopper is rocked to a non-interference position shown by the two dot and chain line in FIG. 3, so that the interference between the stapler 101 and the trail end stopper is avoided. After a staple process (described later) is finished, when the shift plate 103 is returned to the home position, the trail end stopper 131 is also returned to its initial position. In order to hold the trail end stopper 131 in the non-interference position or retard position during the operation of the stapler 101, a plurality of such stopper laying rollers 112 are provided along the shifting direction of the shift plate 103.

Staple stoppers 113 (shown by the two dot and chain line in FIG. 2) provided with a support surface having the same configuration as the abutment support surface 131*a* of the trail end stopper 131 are disposed on both side surfaces of the holder 102 for holding the stapler 101, so that, even when the trail end stopper 131 is in the retard position, the trail ends of the sheets can be supported.

<Detailed Explanation of Process Tray Unit>

Next, the process tray unit 129 will be fully described with reference to FIG. 5.

The process tray unit 129 is constituted by the process tray 130, the trail end stopper 131, an align means 140, the rock guide 150, retract paddles 160, the retractable tray 170 and the pair of bundle discharge rollers 180.

In this case, the process tray 130 is located in an inclined condition that a downstream (in a discharging direction of the sheet bundle) (left in FIG. 5) end of the tray becomes higher than an upstream (right in FIG. 5) of the tray. The trail end stopper 131 is positioned at the upstream or lower end of the tray, and, the retract paddles 160 and the align means 140 are positioned at an intermediate portion of the tray on both sides thereof, and, the rock guide 150 including the retract paddles 160 and the pair of bundle discharge rollers 180 is positioned at the downstream or upper end of the tray (upper area of the unit). Further, the retractable tray 170 is positioned at the downstream or upper end of the tray (lower area of the unit) above the stack tray 200. These elements will be described later.

The sheet P discharged from the pair of first discharge rollers 7 is slid on the process tray 130 by its own weight and by the action of the retract paddles 160 (described later) until the trail end of the sheet P abuts against the abutment support surface 131*a* of the trail end stopper 131.

As mentioned above, the lower bundle discharge roller 180*a* forming the part of the pair of the bundle discharge rollers 180 is positioned at the upper end of the process tray 130, and the other bundle discharge roller 180*b* which can be engaged by and disengaged from the lower bundle discharge roller 180*a* is positioned at the front and rear part of the rock guide 150. The pair of bundle discharge rollers 180*a*, 180*b* can be rotated reversibly by a drive motor M180.

<Detailed Explanation of Align Means>

Next, the align means 140 will be fully described with reference to FIGS. 5 and 6.

A set of align members 141, 142 constituting the align means 140 are disposed in an opposed relation on the process tray 130 in correspondence to both lateral edges of the sheet P at an upper portion (front portion) and a lower portion (rear portion). The first front align member 141 and the second rear align member 142 have align surfaces 141*a*, 142*a* (perpendicular to the surface of the process tray 130) for urging and supporting the lateral edges of the sheet, and rack gear portions 141*b*, 142*b* for supporting the rear surface of the sheet. The rack gear portions 141*b*, 142*b* are disposed below the rear surface of the process tray through a set of parallel guide slots 130*a*, 130*b* formed in the process tray 130 in an up-and-down direction (corresponding to the width-wise direction of the sheet P).

That is to say, briefly speaking, the align surfaces 141*a*, 142*a* are disposed on the upper surface of the process tray 130 in the opposed relation, and the rack gear portions are assembled below the rear surface of the process tray for shifting movement in the aligning direction.

Pinion gears 143, 144 reversibly rotated by drive motors M141, M142 are meshed with the rack gear portions 141*b*, 142*b* so that the first and second align members 141, 142 can be shifted in the aligning direction. There are provided position sensors (not shown) for detecting home positions of the first and second align members 141, 142. Normally, the first align member 141 is positioned at a home position at the upper end side (front side) and the second align member 142 is positioned at a home position at the lower end side (rear side).

<Detailed Explanation of Rock Guide>

Next, the rock guide 150 will be fully described with reference to FIG. 5.

As mentioned above, the rock guide 150 is provided at its front lower end portion (corresponding to the downstream end or left end in FIG. 5) with the upper bundle discharge roller 180*b* which can be urged against the lower bundle discharge roller 180*a* of the bundle discharge roller pair 180, and a rear lower end portion (corresponding to the upstream end or right end in FIG. 5) of the rock guide is pivotally mounted on a support shaft 151. The rocking movement of the rock guide is controlled by a rotation cam 152 driven by a drive motor M150. The rock guide 150 has a home position (closed condition) where the upper bundle discharge roller 180*b* is urged against the lower bundle discharge roller 180*a*, which home position can be detected by a position sensor (not shown).

In a normal condition, when the sheets P are discharged onto the process tray 130, the roller pair 180 and the guide 150 are shifted to an open condition (that the upper bundle discharge roller 180*b* is separated from the lower bundle discharge roller 180*a* by the upward rocking movement of the rock guide 150), so that-the discharging and aligning of the sheets are permitted and the operation of the retract paddles (described later) is also permitted. After the process of the sheet bundle is finished, when the sheet bundle on the process tray 130 is discharged onto the stack tray 200, the roller pair 180 and the guide 150 are shifted to the closed condition (that the upper bundle discharge roller 180*b* is urged against the lower bundle discharge roller 180*a* by the downward rocking movement of the rock guide 150).

<Detailed Explanation of Retract Paddles>

Next, the retract paddles 160 will be fully described.

Figure 5:
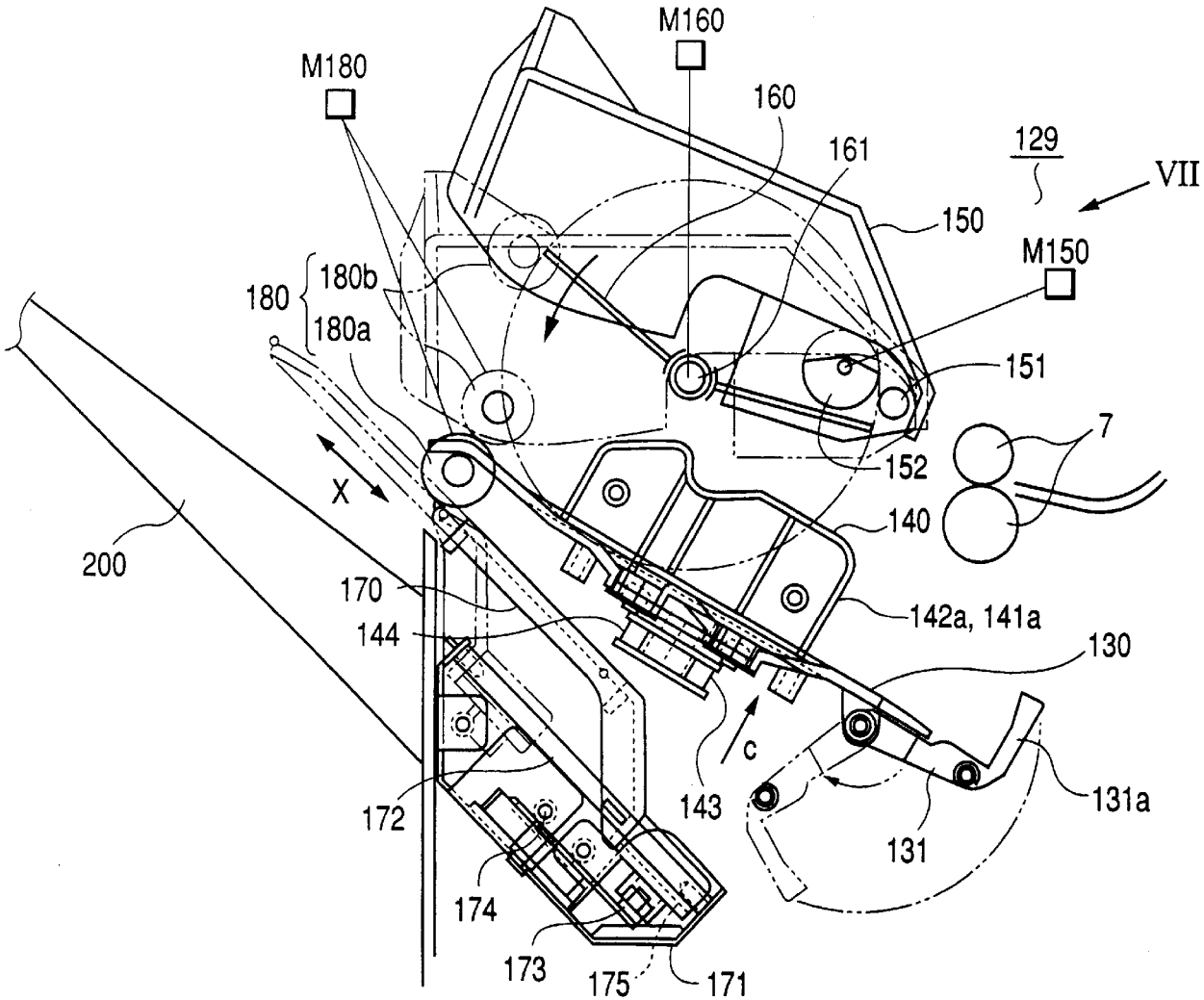
FIG. 5 is a longitudinal side view showing a rock guide and a process tray.
Figure 6:
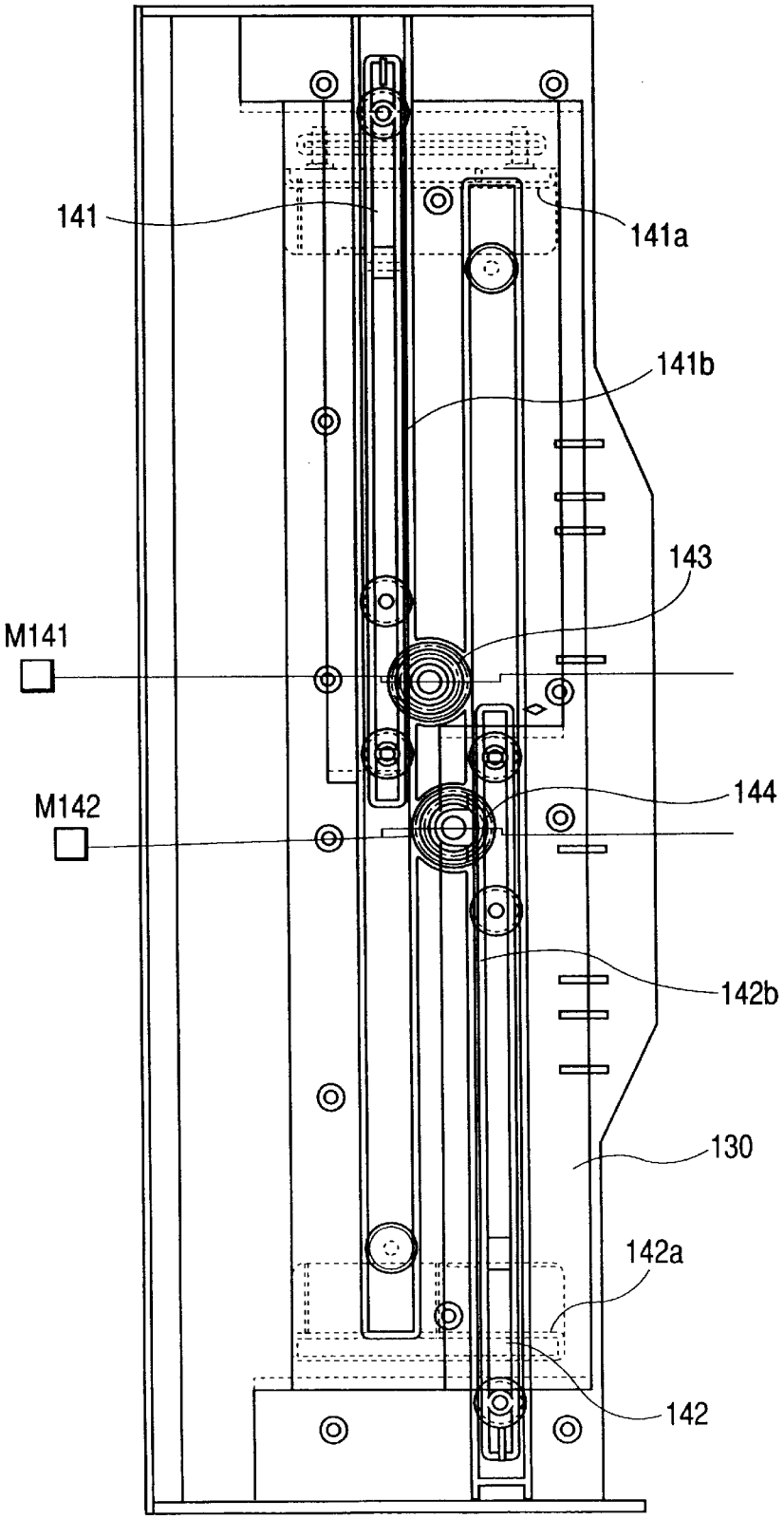
FIG. 6 is a back view showing the process tray and an align wall shifting mechanism.

The retract paddles 160 are located above the process tray (FIG. 5) and are secured to a shaft 161 and can be rotated in an anti-clockwise direction in FIG. 5 by a drive motor M160 at a proper timing. A length of each retract paddle 160 is selected to become slightly greater than a distance between the shaft 161 and the surface of the process tray 130, and a home position (shown by the solid line in FIG. 5) of the retract paddle is selected so that the retract paddle does not obstruct the discharging of the sheet P from the pair of first discharge rollers 7 onto the process tray 130.

In this condition, when the sheet P is discharged onto the process tray 130, the retract paddles 160 are rotated in the anti-clockwise direction to retract the sheet P discharged on the process tray 130 until the trail end of the sheet abuts against the abutment support surface 131*a* of the trail end stopper 131. Thereafter, the retract paddles are returned, at a predetermined timing, to the home position detected by the position sensor (not shown).

<Detailed Explanation of Retractable Tray>

Figure 7:
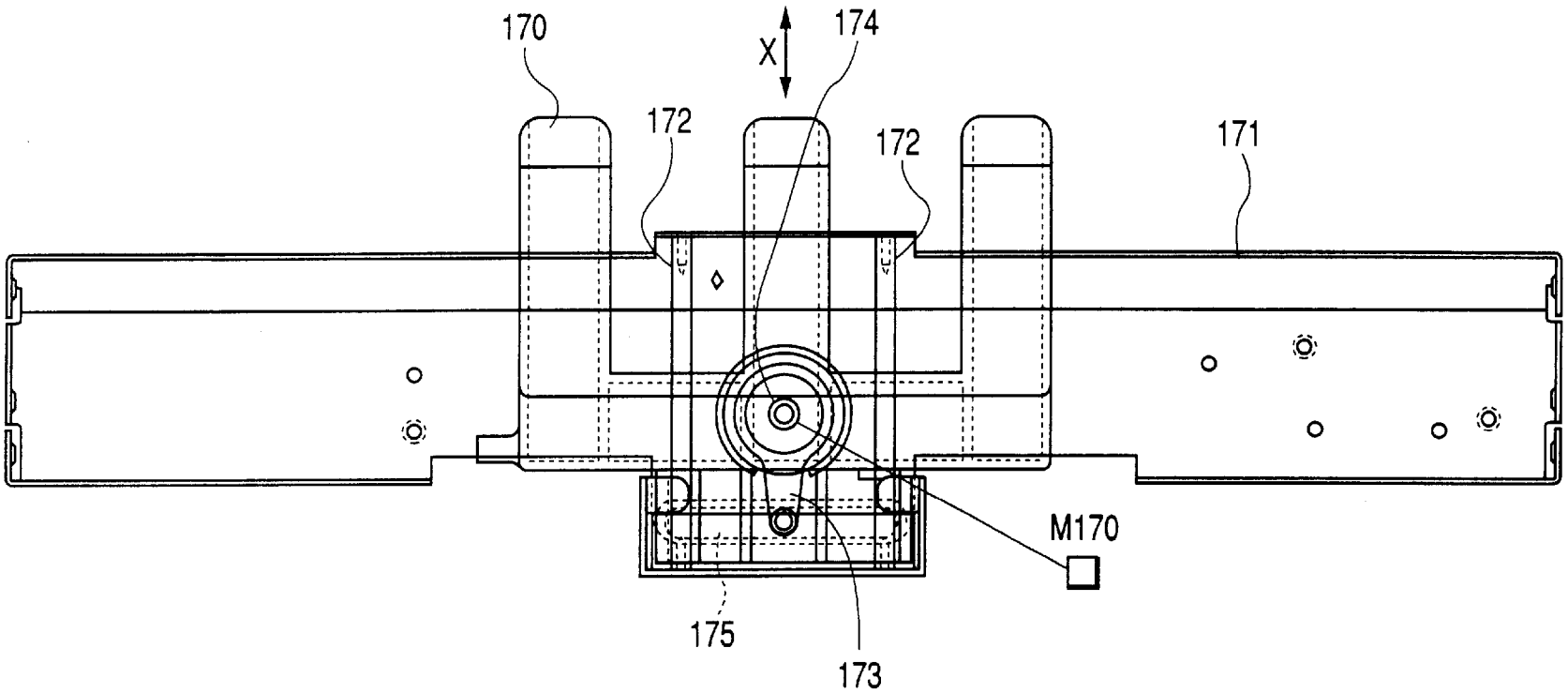
FIG. 7 is a plan view of a retractable tray.

Next, the retractable tray 170 will be fully described with reference to FIGS. 5 and 7.

The retractable tray 170 is disposed below the lower bundle discharge roller 180*a* of the bundle discharge roller pair 180 and can be extended and retracted in the sheet bundle discharging direction (shown by the arrow X in FIGS. 5 and 7) substantially along the inclination of the process tray 130. That is to say, in an extended position, a tip end of the retractable tray 170 is protruded toward an upper side of the stack tray 200 (as shown by the two dot and chain line in FIG. 5), and, in a retracted position (home position), the tip end of the retractable tray is retracted inwardly of the lower bundle discharge roller 180*b* (as shown by the solid line in FIG. 5). The extended condition of the retractable tray 170 is selected so that the gravity center of the sheet P discharged on the process tray 130 does not exceed the extended position, i.e., the tip end portion of the sheet P is not depended downwardly.

The retractable tray 170 is slidably supported by a pair of guide rails 172 secured to a frame 171, and a rotary cam sub-roller 173 rotated around a shaft 174 is received in a groove 175 formed in the lower surface of the retractable tray 170. The retractable tray 170 is extended and retracted by rotation of the rotary cam sub-roller 173 effected by a drive motor M170. In a normal condition, the retractable tray is located at the home position detected by a position sensor (not shown).

<Detailed Explanation of Stack Tray and Sample Tray>

Next, the stack tray 200 and the sample tray 201 will be fully described with reference to FIGS. 8 and 9.

The stack tray 200 and the sample tray 201 are used properly on demand. That is to say, the stack tray 200 positioned at a lower side is selected when the sheet bundle is received in the copy output and printer output, and the sample tray 201 positioned at an upper side is selected when the sheet is received in the sample output, interruption output and job mix stack output.

The stack tray 200 and the sample tray 201 are hold by a tray base plate 202 and 203, respectively and are self-shifted independently in an up-and-down direction by stepping motors M200 and M201 secured to the base plates 202 and 203 via attachment frame plates 204 and 205. In this case, since the stack tray 200 and the sample tray 201 have the same construction, only the stack tray 200 will be explained mainly.

A pair of frames 250 are provided on both vertical ends of the sheet process apparatus 1, and rack gear members 251 also acting as vertical guide rail portions are attached to the frames. A pair of guide sub-rollers 206, 207 rotatably provided on a rear end portion extended from one (202) (left side regarding the width-wise direction of the sheet) of the tray base plates and a rear end of a rear end portion extended from the attachment frame plate 204 opposed (right side regarding the width-wise direction of the sheet) to the base plate 202 are received in the corresponding guide rail portions, so that the stack tray 200 is held for vertical movement. Further, by engaging a regulating member 208 by a bent end of one of the frames 250, any play in the width-wise direction of the sheet is absorbed.

On the other hand, rotational output of the stepping motor M200 is transmitted to a pulley 212 of a drive shaft 213 via a timing belt 211. A ratchet wheel 215 provided on the drive shaft 213 for only sliding movement and biased by a spring 216 is engaged by a drive gear 214 on the shaft for permitting one-way driving. One of a pair of idler gears 218 provided on both ends of a driven shaft 217 is meshed with the drive gear 214, and the idler gears 218 are engaged by the rack gear members 251 via lift/lower gears 219. That is to say, the stack tray 200 can be lifted and lowered through a drive system comprised of such a gear train.

The ratchet wheel 215 provided on the drive shaft 213 and biased toward one direction is arranged so that, when the stack tray 200 is lowered, a foreign matter is not pinched, thereby preventing damage of the gear train. In the illustrated embodiment, a biasing force of the spring 216 is selected to a predetermined value so that, only when the stack tray 200 is lifted, the ratchet wheel is idly rotated in opposition to the biasing force of the spring 216 if the predetermined condition is exceeded, thereby protecting the gear train. In case of the idle rotation, i.e., if abnormality occurs, in order to immediately stop the stepping motor M200, a clock slit formed in a flange portion of the drive gear 214 is detected by a sensor S201. Incidentally, the sensor S201 is also used to detect out-of-phase during the normal operation.

Now, sensors for controlling lifted and lowered position of the stack tray 200 and the sample tray 201 will be described.

A sensor S202 serves to detect a stacking area of the sample tray 201 and detects the fact that the tray is located within a range belonging an area from a lifted position detect sensor S203*a* to a process tray sheet surface detect sensor S205. A sensor S203*b* serves to detect the fact that the number of sheets P discharged from the pair of second discharge rollers 9 onto the sample tray 201 reaches a predetermined value. In the illustrated embodiment, the sensor S203*b* is located at a height position corresponding to a thickness of 1000 sheets, above a non-sort sheet surface detect sensor S204.

A sensor S203*c* serves to detect the fact that the number of sheets P discharged from the process tray 130 onto the sample tray 201 reaches a predetermined value. In the illustrated embodiment, the sensor S203*c* is located at a height position corresponding to a thickness of 2000 sheets, above the sheet surface detect sensor S205. A sensor S203*d* serves to limit a stacking height when the stack tray 200 receives the sheets P from the process tray 130. In the illustrated embodiment, the sensor S203*d* is located at a height position corresponding to a thickness of 2000 sheets, above the sheet surface detect sensor S205.

A sensor S203*e* serves to set a lower limit position of the stack tray 200. The stack tray 200 and the sample tray 201 are provided with sheet presence/absence detect sensors S206*a* and S206*b*, respectively.

Among these sensors, only the sheet surface detect sensors S204, S205 are of light permeable type for detecting the presence/absence of the sheet by light from one lateral edge to the other lateral edge of the sheet P. In the illustrated embodiment, as a method for detecting the sheet surfaces, initial positions are determined as conditions that the trays 200, 201 are lifted from below the sheet surface detect sensors S204, S205 to positions where the sensors are covered by the trays, and, after the sheet is stacked, the trays are lowered until the sensor optical axes are revealed and thereafter the trays are lifted until the sensor optical axes are covered, and such operations are repeated.

<Detailed Explanation of Flow of Sheet P>

Figure 10:
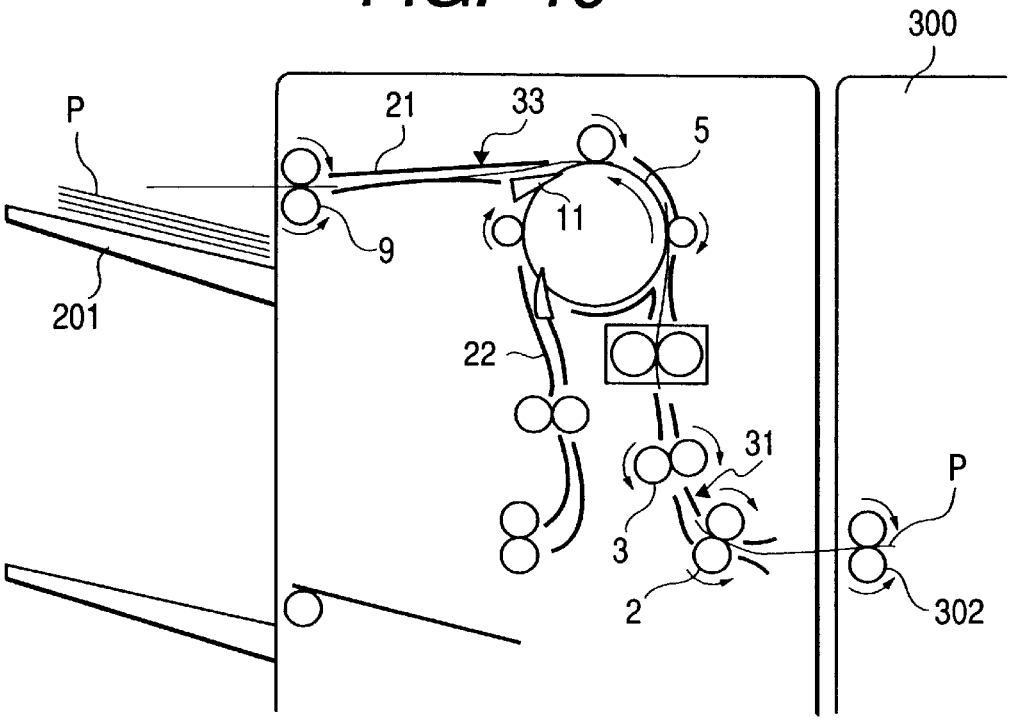
FIG. 10 is a view for explaining an operation of the sheet process apparatus in a non-sort mode.

When the operator selects a non-sort mode via an operation portion (not shown) of the image forming apparatus, the pair of inlet rollers 2, the pair of convey rollers 3 and the large convey roller (buffer roller) 5 are rotated as shown in FIG. 10 to convey the sheet P conveyed from the image forming main body 300. The flapper 11 is rotated to a position shown in FIG. 10 by a solenoid (not shown) to convey the sheet P into the non-sort path 21. After the trail end of the sheet P is detected by the sensor 3*s*, the pair of rollers 9 are rotated at a speed suitable for stacking, thereby discharging the sheet P onto the sample tray 201.

Next, an operation when the operator selects the staple sort mode will be explained.

Figure 11:
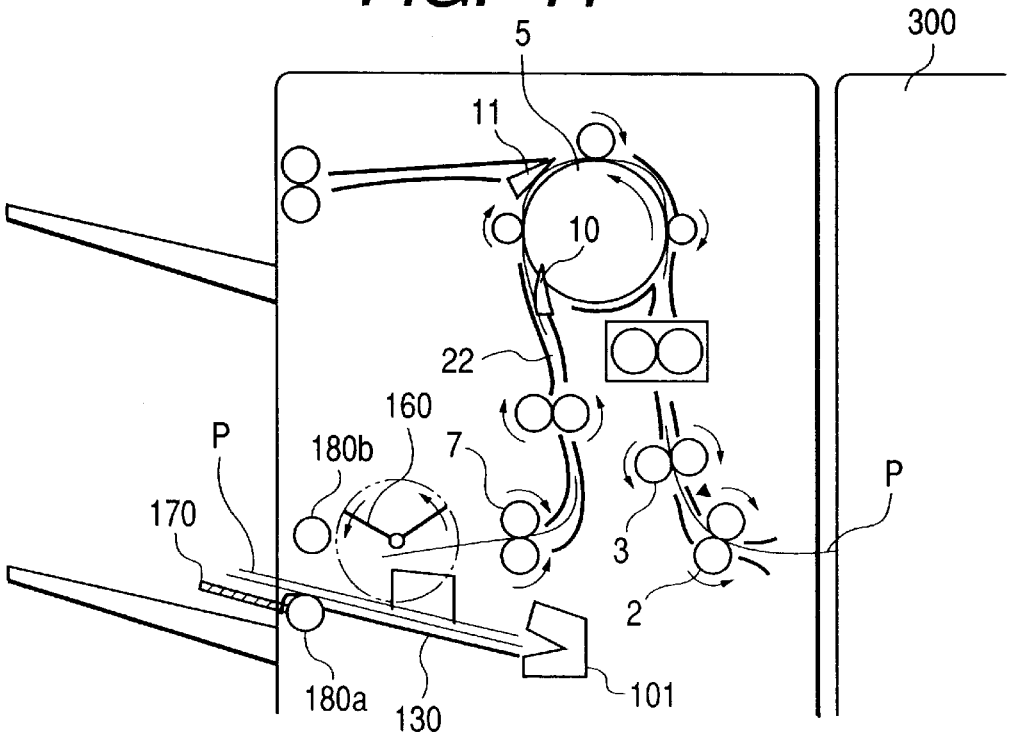
FIGS. 11, 12, 13, 14, 15, 16, 17, 18A and 18B are views for explaining an operation of the sheet process apparatus in a staple sort mode.

The flappers 10, 11 are stopped at positions shown in FIG. 11. The pair of inlet rollers 2, the pair of convey rollers 3 and the large convey roller 5 are rotated to convey the sheet P conveyed from the image forming main body 300. The sheet P passes through the sort path 22 and is discharged onto the process tray 130 by the pair of first discharge rollers 7. In this case, since the retractable tray 170 is in the extended position, the tip end of the sheet is prevented from being suspended downwardly when the sheet P is discharged by the pair of first discharge rollers 7, thereby preventing poor returning and improving the aligning ability of the sheets on the process tray.

The discharged sheet P starts to shift toward the trail end stopper 131 by its own weight, and, the paddle which were stopped at the home position are rotated in the anti-clockwise direction by the motor M160 to aid the shifting of the sheet. When the trail end of the sheet abuts against the stopper 131 and is stopped there, the paddles 160 are also stopped, and the discharged sheet is aligned by the align members.

Figure 12:
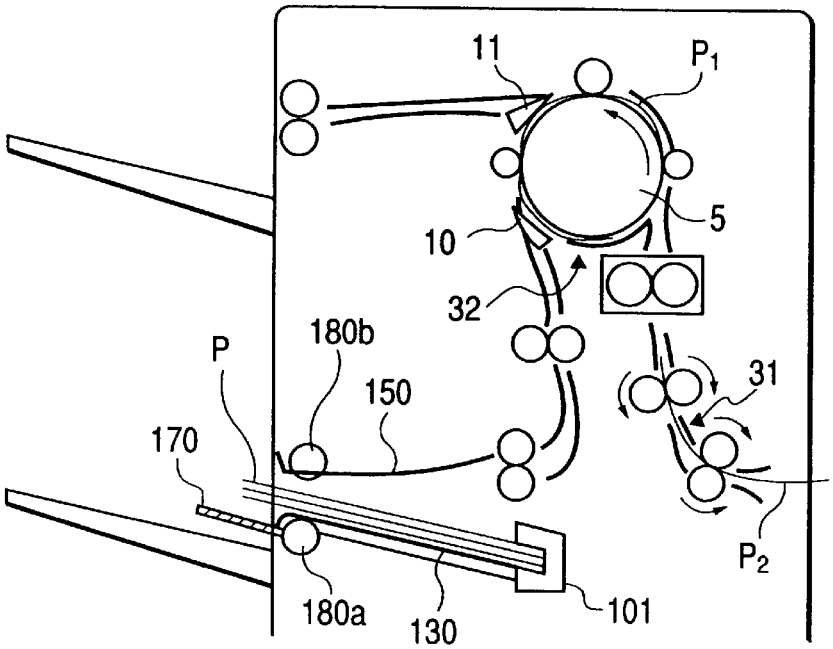

After all of the sheets constituting the first part are discharged on the process tray 130 and are aligned to each other, as shown in FIG. 12, the rock guide 150 is lowered to urge the upper bundle discharge roller 180*b* against the sheet bundle, and the sheet bundle is stapled by the stapler 101.

Figure 13:
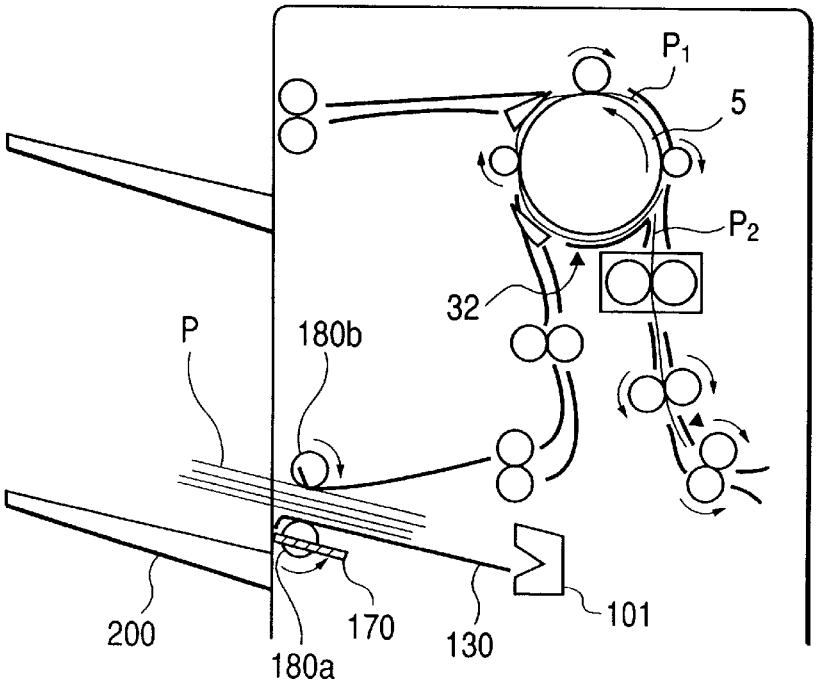
Figure 14:
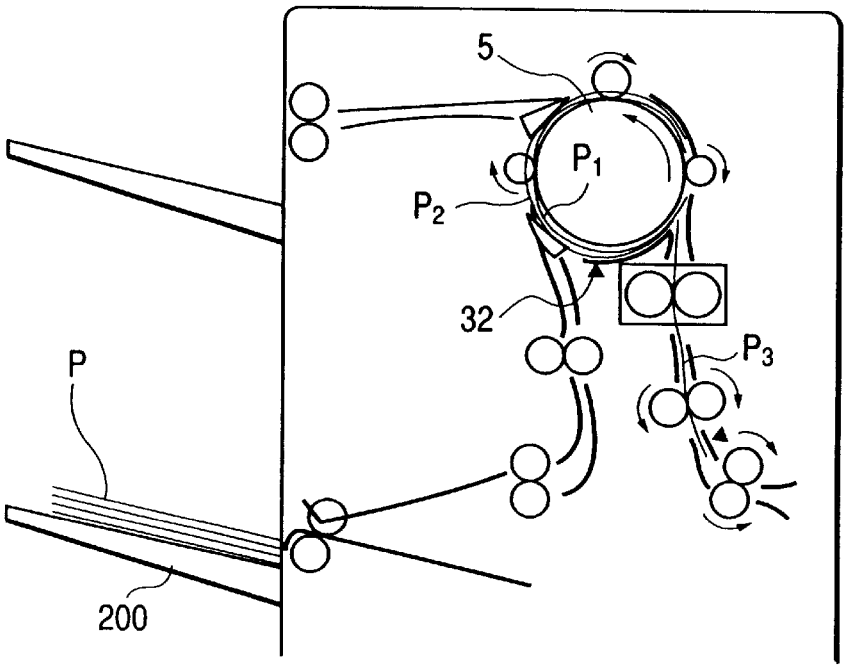

Meanwhile, as shown in FIG. 12, the sheet $P_1$ discharged from the image forming main body 300 is wound around the large convey roller 5 by the rotation of the flapper 10 and is stopped at a position spaced apart from the sensor 32 by a predetermined distance. When a next sheet $P_2$ advances from the sheet detect sensor 31 by a predetermined distance, as shown in FIG. 13, the large convey roller 5 is rotated to advance the second sheet $P_2$ greater than the first sheet $P_1$ by a predetermined distance, thereby overlapping the sheets together, and, as shown in FIG. 14, the sheets $P_1$, $P_2$ are wound around the large convey roller 5 and the large convey roller is stopped at a predetermined distance. On the other hand, the sheet bundle on the process tray 130 is discharged onto the stack tray 200. However, in this case, the retractable tray 170 is shifted to the home position before the sheet bundle leaves the pair of bundle discharge rollers, thereby permitting the dropping of the sheet bundle onto the stack tray 200.

Figure 15:
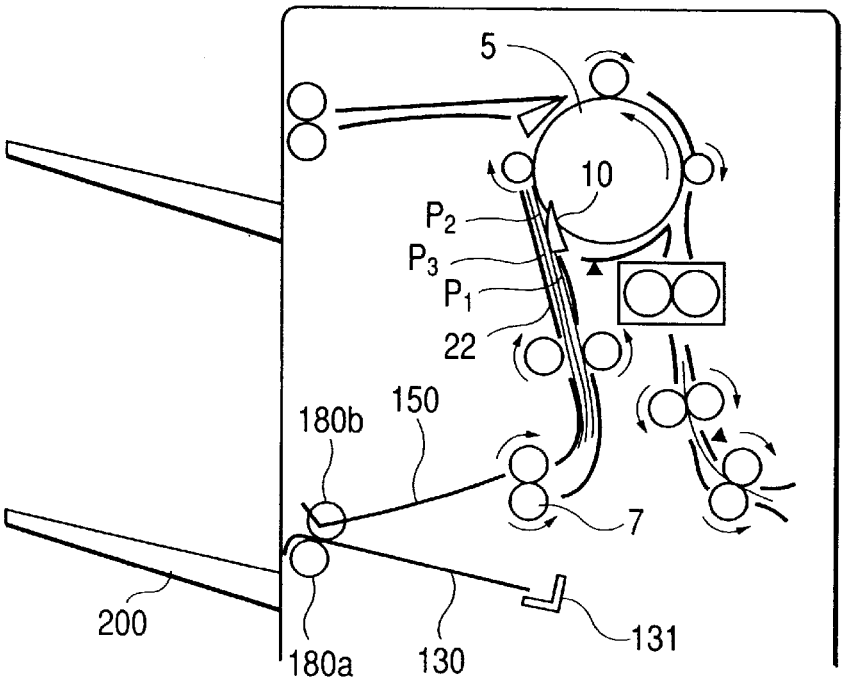

As shown in FIG. 15, when a third sheet $P_3$ reaches a predetermined position, the large convey roller 5 is rotated to overlap the third sheet $P_3$ with slight distance deviation, and the flapper 10 is rotated to permit the conveyance of three sheets into the sort path 22.

Figure 16:
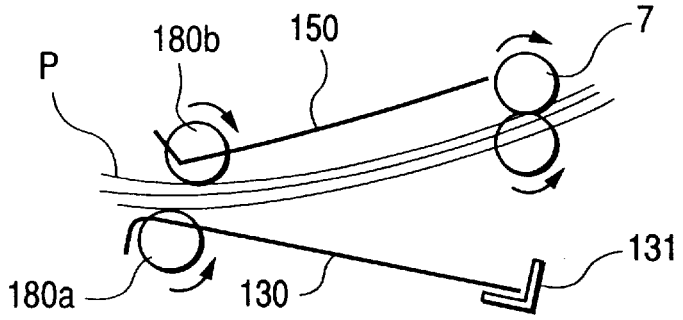
Figure 17:
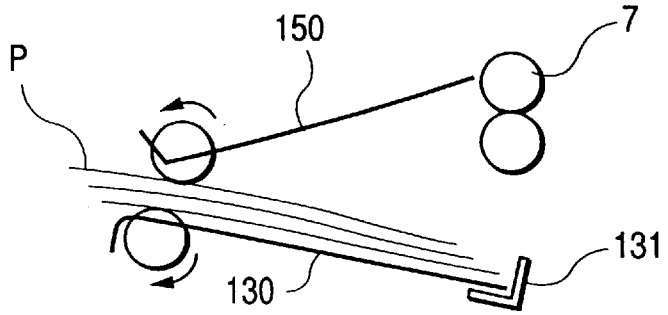
Figure 18A:
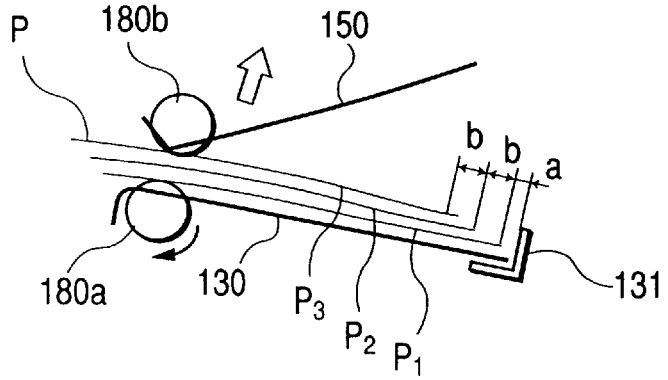
Figure 18B:
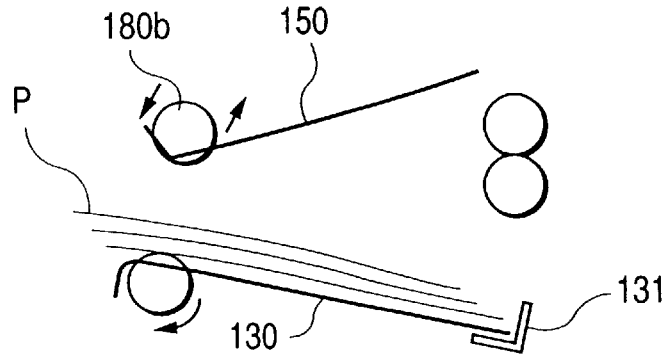

As shown in FIG. 16, in the condition that the rock guide 150 is lowered, three sheets P are received by the bundle discharge rollers 180*a*, 180*b*. As shown in FIG. 17, when the trail ends of the sheets leave the pair of first discharge rollers 7, the bundle discharge rollers 180*a*, 180*b* are rotated reversely. Before the trail end of the sheet bundle abuts against the trail end stopper 131 (FIG. 18A), as shown in FIG. 18B, the rock guide 150 is lifted to separate the roller 180*b* from the sheet surface. Similar to the first part, a fourth sheet and so on are passed through the sort path and are discharged onto the process tray. Regarding a third part and so on, the operation similar to the second part are repeated. In this way, a predetermined number of parts (sheet bundles) are stacked on the stack tray 200, and then the operation is finished.

In the above-mentioned overlap conveyance of the plurality of sheets, the sheets P are offset from each other in the conveying direction. For example, the sheet $P_2$ is offset from the sheet $P_1$ toward the downstream side, and the sheet $P_3$ is offset from the sheet $P_2$ toward the downstream side.

A timing between the offset amount of the sheet and the lifting of the rock guide 150 depends upon the settling time of the sheet determined by the returning speed of the bundle discharge roller pair, i.e., the timing is determined on the basis of the processing ability of the image forming main body 300. In the illustrated embodiment, when the sheet conveying speed is 750 mm/s, offset amount (b) is about 20 mm and returning speed of the bundle discharge roller pair is about 500 mm/s, the separation timing of the bundle discharge roller pair is selected to a time when the sheet $P_1$ reaches a position in front of the stopper by about 40 mm (value "a" in FIG. 18A).

<Detailed Explanation of Sort Mode>

Figure 19:
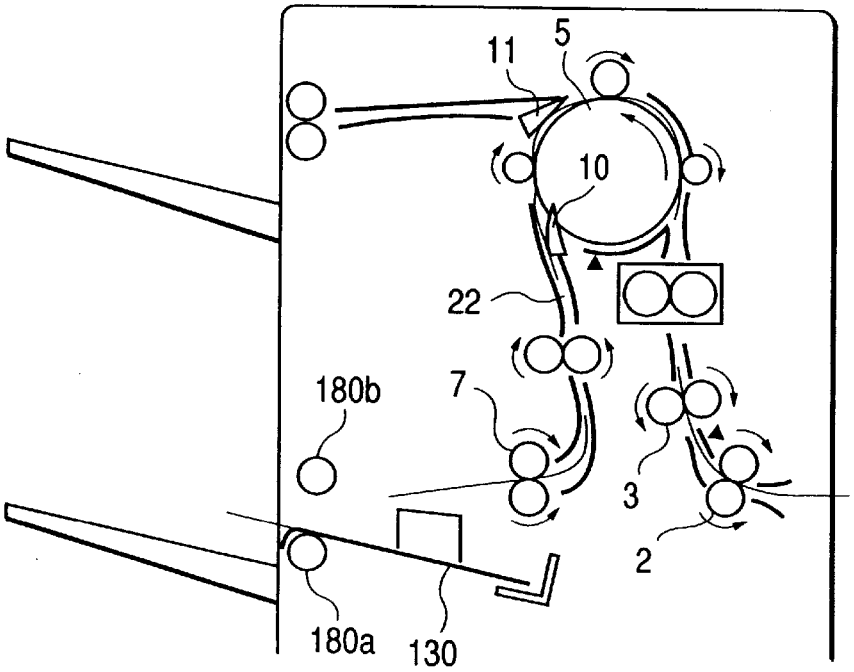
FIGS. 19 and 20 are views for explaining an operation of the sheet process apparatus in a sort mode.
Figure 20:
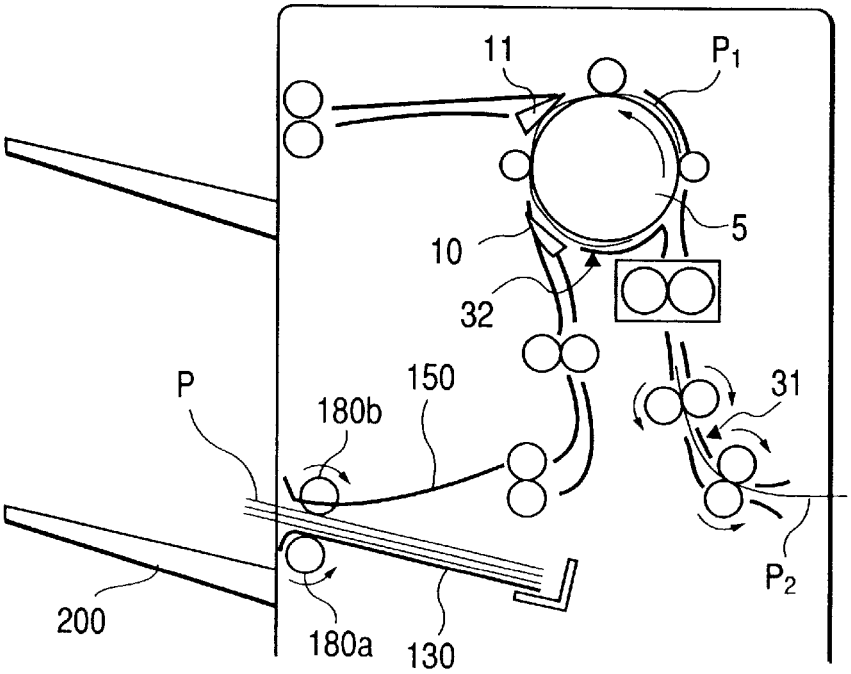

The operator sets the originals in the RDF 400, selects the sort mode via the operation portion (not shown) and turns a start key (not shown) ON. As is in the staple sort mode, the pair of inlet rollers 2 and the pair of convey rollers 3 are rotated as shown in FIG. 19 similar to the staple sort mode to stack the sheets P on the process tray 130. After small number of sheets on the process tray 130 are aligned together by the align means 140, as shown in FIG. 20, the rock guide 150 is lowered, so that the small number of sheets are bundle-conveyed by the rollers 180*a*, 180*b*.

Then, the conveyed sheet passes over the flapper 10 and is wound around the large convey roller 5 as is in the staple sort mode and is discharged onto the process tray 130 after the bundle-discharge is finished. From tests, it was found that the number of sheets included in the sheet bundle to be bundle-discharged is desirably twenty or less. The number is selected to satisfy the following relation:

$$\text{Number of originals} \geqq \text{number to be bundle-discharged} \leqq 20$$

Thus, when the program is set so that the number to be bundle-discharged becomes five (5), if the number of originals is four (4), the sheet bundle including four sheets are bundle-discharged. If the number of originals is greater than five, for example, the number of originals is 14, the sheets are aligned and bundle-discharged as groups of five sheets, five sheets and four sheets.

Regarding the second part, the sheets are aligned together at the offset position and are bundle-discharged every small number of sheets similar to the first part. After the second part was processed, the front align member and the rear align member 143 are returned to the position where the first part is aligned and are used to align a third part.

Incidentally, there is an embodiment for reducing an influence of the discharged sheet bundle upon the already stacked sheets by determining the number of sheets included in a non-stapled sheet bundle on the basis of a length of the sheet in a sheet conveying direction, and such an embodiment will be explained with reference to FIGS. 22A to 22C and FIG. 23.

<Detailed Explanation of Movements of Stack Tray 200 and Sample Tray 201>

Figure 8:
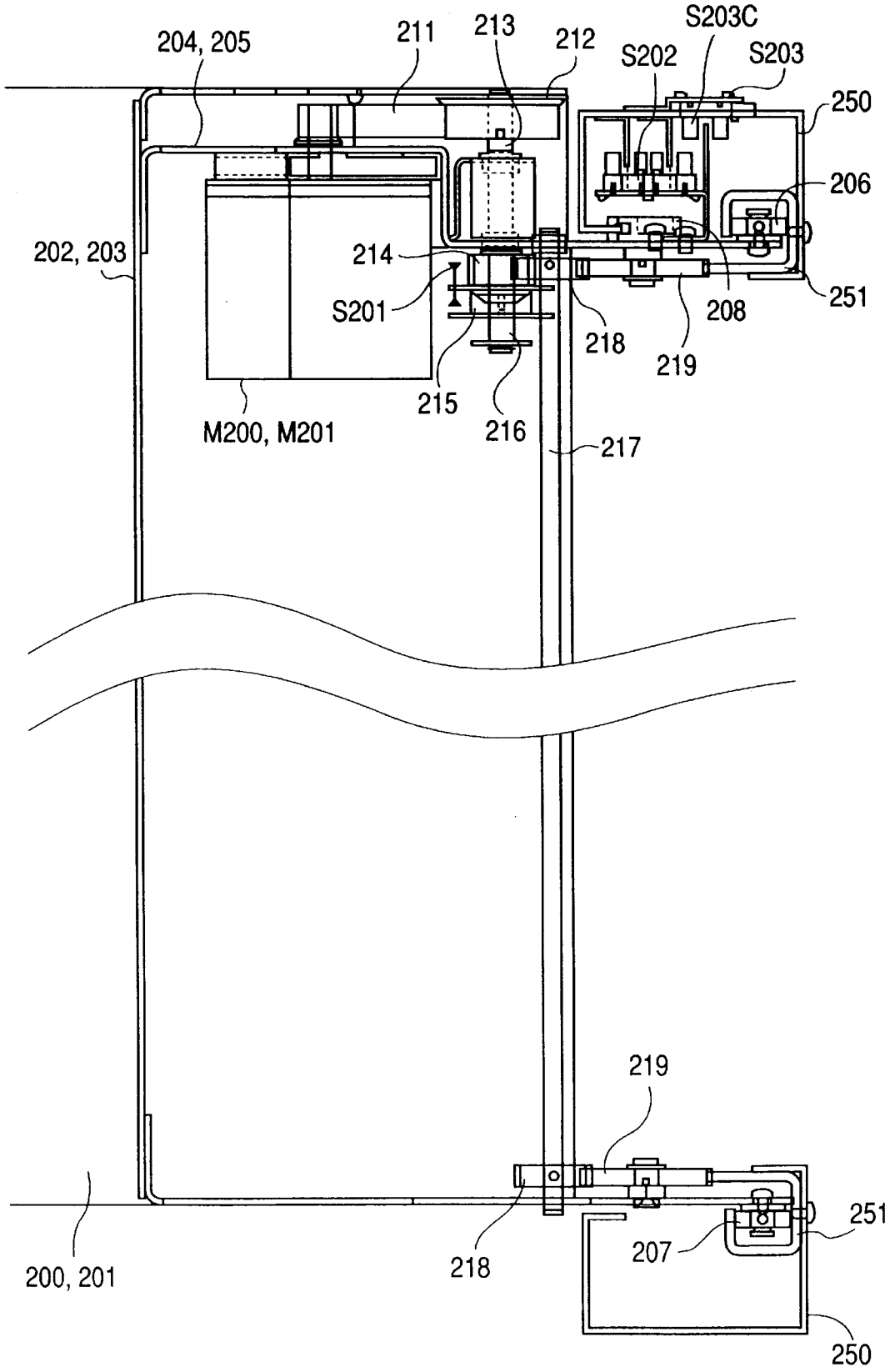
FIG. 8 is a plan view of a stack tray shifting mechanism.
Figure 9:
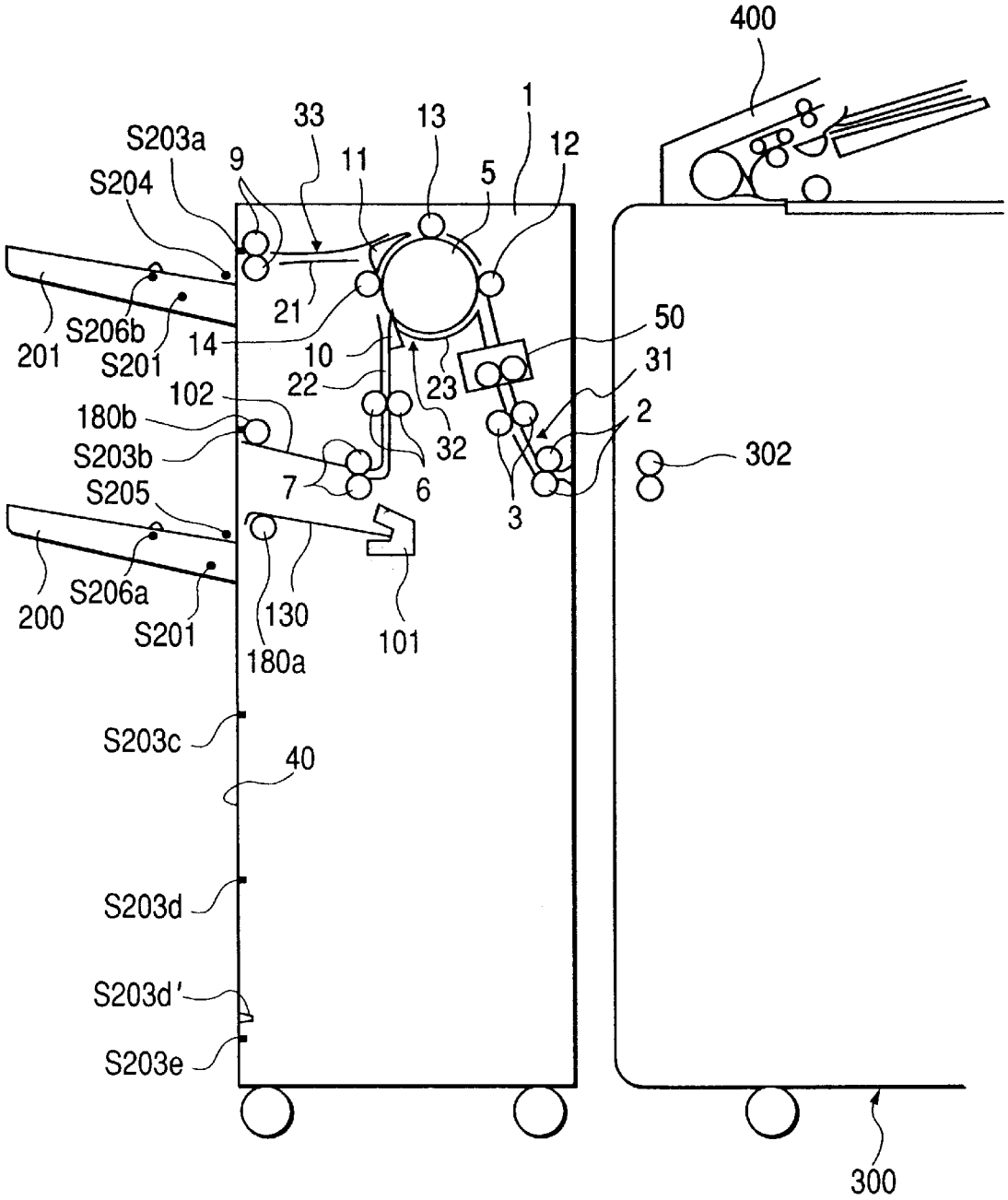
FIG. 9 is a view showing arrangement of sensors around a stack tray.

In FIGS. 8 and 9, the sample tray 201 and the stack tray 200 are normally waiting at the sheet surface detect sensor positions (normal stacking positions) S204, S205. The copy output or printer output is normally stacked on the stack tray 200, and the stack tray can receive the sheets processed by the stapler 101 or the sheet bundle including small number of non-stapled sheets. The tray 200 can receive 2000 sheets at the maximum, and the stacking of the sheets is detected by the sensor S203*d*.

When the copy output from the printer is further continued, the stack tray 200 is lowered from the sensor S203*d* by a distance corresponding to a thickness of 1000 sheets (to a position shown by "S203*d*'" in FIG. 9). Then, the sample tray 201 is lowered up to the sheet surface detect sensor S205 for the sample tray to start to receive the sheets again. The sample tray 201 can receive 1000 sheets at the maximum, and the stacking of the sheets is detected by the sensor S203*c*.

Then, after the job for 2000 sheets or less is finished, when the next job is started without removing the sheets on the stack tray 200 or when interruption is effected during the present job, the process operation cannot be performed, but, the sheets can be discharged from the non-sort discharge path 21 by using the sample tray 201. In the normal condition, as mode in which the sheets are outputted to the sample tray 201 by using the non-sort discharge path 21, there are a mode in which the sheet included in only one part are outputted for sampling without no process and a mode in which sample tray output is set to function sort.

Next, main portions (according to the present invention) of the sheet process apparatus will be explained with reference to FIGS. 22A to 22C and FIG. 23.

As shown in FIG. 19 and FIGS. 22A to 22C, the small number of non-stapled sheets discharged on the process tray 200 are discharged onto the stack tray 200 by the rotation of the bundle discharge roller pair 180. The number of non-stapled sheets is determined on the basis of the length of the sheet in the sheet conveying direction.

Figure 22A:
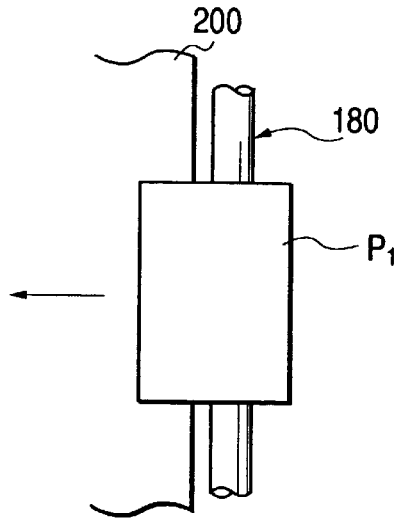
FIGS. 22A, 22B and 22C are plan views showing a bundle discharge roller pair and a stack tray portion and further showing a small size sheet, an R-type size sheet and a large size sheet, respectively.
Figure 22B:
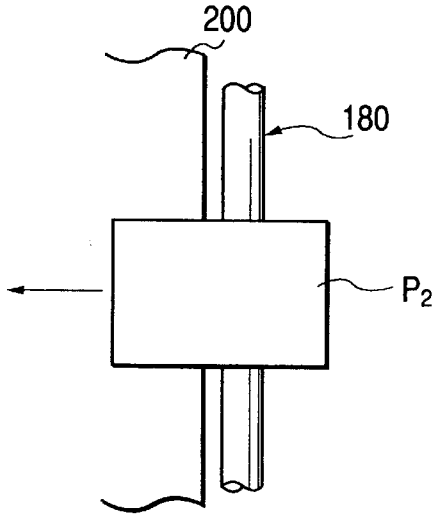
Figure 22C:
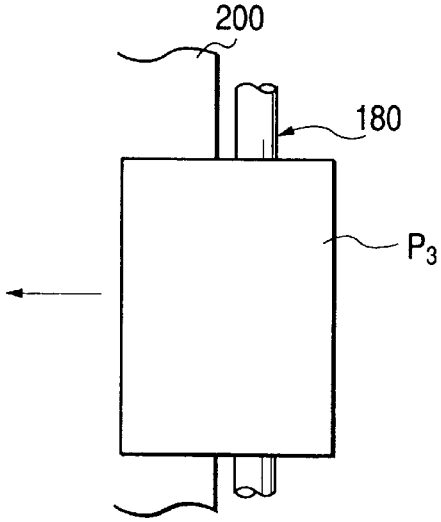

The sheet bundle $P_1$ to be discharged as shown in FIG. 22A includes sheets having small size such as B5 size, A4 size or LTR size, the sheet bundle $P_2$ shown in FIG. 22B includes sheets having R-type size such as LTRR size, A4R size or B5R size, and the sheet bundle $P_3$ shown in FIG. 22C includes sheets having large size such as B4 size, A3 size or LEGL size. And, the number of sheets included in the sheet bundle is determined on the basis of the above size. For example, in case of the small size sheet bundle $P_1$ and R-type size sheet bundle $P_2$, the number of sheets in the sheet bundle is selected to five, and, in case of the large size sheet bundle $P_3$, the number of sheets in the sheet bundle is selected to three.

By determining the number of sheets in the sheet bundle on the basis of the length of the sheet in the sheet conveying direction in this way, the non-stapled sheet bundle can stably discharged without disordering the already stacked sheets.

The size of the sheet stacked on the process tray 200 may be detected by a sheet size detect means S211 of the image forming main body 300 from which the sheet is supplied to the sheet process apparatus 1, and the number of sheets in the sheet bundle may be determined on the basis of the detected sheet size. For example, the sheet sizes are grouped into small size (smaller than 200 mm (in length) in the sheet conveying direction), middle size (from 200 mm to 400 mm (in length) in the sheet conveying direction), and large size greater than 400 mm (in length) in the sheet conveying direction), and, in case of the small size sheet bundle and the middle size sheet bundle, the number of sheets in the sheet bundle is selected to five, and, in case of the large size sheet bundle $P_3$, the number of sheets in the sheet bundle is selected to three.

On the basis of detection of the size of the sheet by means of the sheet size detect means S211 and detection of the number of sheets discharged on the process tray 130 by means of a sheet number detect means S212, the bundle discharge roller pair 180 is driven by the bundle discharge motor M180, thereby discharging the predetermined number of sheets depending upon the sheet size.

Figure 23:
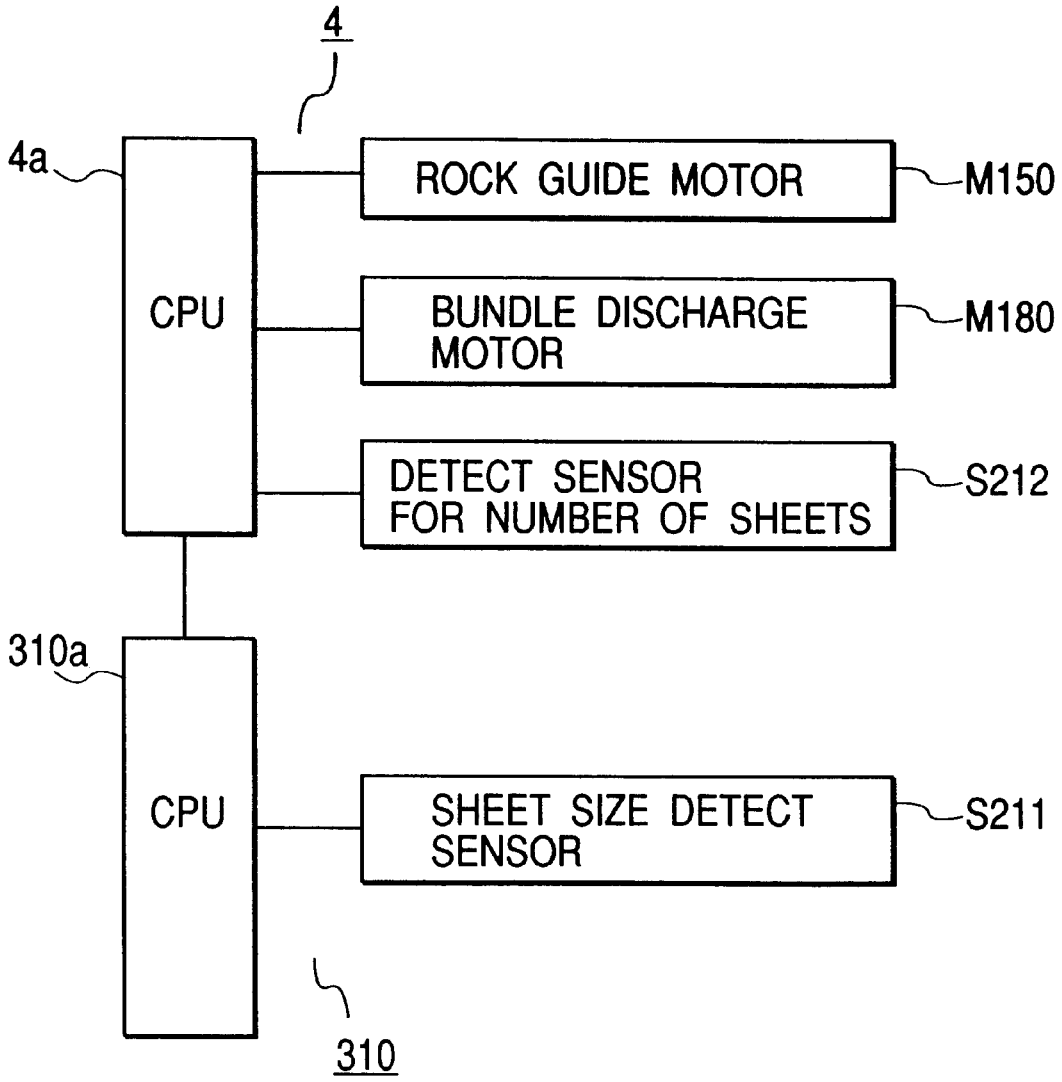
FIG. 23 is a control block diagram of the sheet process apparatus according to the present invention.

The control for determining the number of sheets (to be discharged) depending upon the sheet size is effected by a control apparatus 4 of the sheet process apparatus and a control apparatus 310 of the image forming apparatus, as shown in FIG. 23.

Incidentally, while an example that the number of sheets in the small size sheet bundle and R-type size sheet bundle is selected to five and the number of sheets in the large size sheet bundle is selected to three was explained, such numbers are only exemplary and do not limit the invention.

What is claimed is:

1. A sheet process apparatus comprising:

sheet discharge means for discharging a sheet;

first stacking means for stacking the sheet discharged by said sheet discharge means;

bundle discharge means for discharging a sheet bundle rested on said first stacking means; and second stacking means for stacking the sheet bundle discharged by said bundle discharge means, wherein when a sheet stack is stacked on said second stacking means, a plurality of sheet bundles are successively piled up to form the sheet stack, and wherein a number of sheets in the sheet bundle to be discharged onto said second stacking means when a length of the sheet in a sheet conveying direction is a large size is smaller than a number of sheets in the sheet bundle to be discharged onto said second stacking means when a length of the sheet in the sheet conveying direction is a small size.

2. A sheet process apparatus according to claim 1, wherein the number of sheets in the sheet bundle discharged by said bundle discharge means when the small size of the sheet in the sheet conveying direction is less than 400 mm is a larger number, and the number of sheets in the sheet bundle discharged by said bundle discharge means when the large size of the sheet in the sheet conveying direction is equal to or larger than 400 mm is a small number.

3. A sheet process apparatus according to claim 1, wherein the number of sheets in the sheet bundle discharged by said bundle discharge means when the length of the sheet in the sheet conveying direction corresponds to one of a sheet size of a B5 size, an A4 size an LTR size, and a R-type size, the R-type size being one of a B5R size, an A4R size, and an LTRR size, is a large number, and the number of sheets in the sheet bundle discharged by said bundle discharge means when the length of the sheet in the sheet conveying direction corresponds to one of an A3 size, a B4 size and an LEGL size, is a small number.

4. A sheet process apparatus according to claim 1, further comprising sheet size detecting means provided in an apparatus body from which the sheet is discharged to the sheet process apparatus and for detecting the length of the sheet in the sheet conveying direction, sheet number counting means for counting the number of sheets discharged onto said first stacking means, and control means for controlling a sheet bundle discharging operation of said bundle discharge means on the basis of a detection result of said sheet size detecting means and a counting result of said sheet number counting means.

5. A sheet process apparatus according to claim 1, wherein the number of sheets in the sheet bundle when the length of the sheet for the small size is smaller than 400 mm is five, and the number of sheets in the sheet bundle when the length of the sheet for the large size is equal to or larger than 400 mm is three.

6. A sheet process apparatus according to claim 1, wherein the number of sheets in the sheet bundle when the small size for the length of the sheet is one of a B5 size, an A4 size, an LTR size, a B5R size, an A4R size, and an LTRR size, and the number of sheets in the sheet bundle when the large size for the length of the sheet is one of an A3 size, a B4 size and a LEGL size is three.

7. A sheet process apparatus according to claim 1, wherein, when a desired number of sheets in the sheet stack to be stacked on said second stacking means is N, sheet bundles including the small number of sheets or the large number of sheets are bundle-discharged plural times so that the desired number N of sheets are stacked on said second stacking means.

8. A sheet process apparatus according to claim 7, wherein said bundle discharge means is a pair of upper and lower rotary members for pinching the sheet bundle on said first stacking means and for conveying the sheet bundle to said second stacking means.

9. An image forming apparatus comprising:

a sheet process apparatus according to one of claims 1, 2, 3, 4, 5, 6, 7 or 8;

image forming means; and conveying means for conveying a sheet on which an image has been formed to said sheet process apparatus.

10. An image forming apparatus comprising:

image forming means;

sheet discharge means for discharging a sheet on which an image has been formed;

first stacking means for stacking the sheet discharged by said sheet discharge means;

bundle discharge means for discharging a sheet bundle rested on said first stacking means;

second stacking means for stacking the sheet bundle discharged by said bundle discharge means;

sheet size detecting means for detecting a size of the sheet; and sheet number counting means for counting a number of sheets discharged onto said first stacking means, wherein when a sheet stack is stacked on said second stacking means, a plurality of sheet bundles are successively piled up to form the sheet stack, and wherein a number of sheets in the sheet bundle discharged from said first stacking means to said second stacking means when a length of the sheet in a conveying direction is a large size is made smaller than a number of sheets in the sheet bundle discharged from said first stacking means to said second stacking means when a length of the sheet in the sheet conveying direction is a small size on the basis of a detection result of said sheet size detecting means and a counting result of said sheet number counting means.

11. An image forming apparatus according to claim 10, wherein the number of sheets in the sheet bundle discharged by said bundle discharge means when the small size of the sheet in the sheet conveying direction is less than 400 mm is a larger number, and the number of sheets in the sheet bundle discharged by said bundle discharge means when the large size of the sheet in the sheet conveying direction is equal to or larger than 400 mm is a small number.

12. An image forming apparatus according to claim 10, wherein the number of sheets in the sheet bundle discharged by said bundle discharge means when the length of the sheet in the sheet conveying direction corresponds to one of a sheet size of a B5 size, an A4 size, an LTR size, and a R-type size, the R-type size being one of a B5R size, an A4R size, and an LTRR size, is a large number, and the number of sheets in the sheet bundle discharged by said bundle discharge means when the length of the sheet in the sheet conveying direction corresponds to one of an A3 size, a B4 size and an LEGL size, is a small number.

* * * * *

UNITED STATES PATENT AND TRADEMARK OFFICE

CERTIFICATE OF CORRECTION

PATENT NO. : 6,264,189 B1
DATED : July 24, 2001
INVENTOR(S) : Wataru Kawata

It is certified that error appears in the above-identified patent and that said Letters Patent is hereby corrected as shown below:

Column 6,
Line 39, "that" should read -- such that --.

Column 8,
Line 52, "hold" should read -- held --.

Column 9,
Line 20, "a" should be deleted.

Column 12,
Line 34, "are" should read -- is --.
Line 35, "are" should read -- is --.

Column 13,
Line 25, "was" should read -- were --.

Signed and Sealed this

Second Day of April, 2002

*Attest:*

*Attesting Officer*

JAMES E. ROGAN
*Director of the United States Patent and Trademark Office*